US010810836B2

(12) United States Patent
Graf et al.

(10) Patent No.: US 10,810,836 B2
(45) **Date of Patent: *Oct. 20, 2020**

(54) SYSTEM AND METHOD FOR REMOTELY CONTROLLING AN ELECTRONIC GAMING DEVICE FROM A MOBILE DEVICE

(71) Applicant: Novomatic AG, Gumpoldskirchen (AT)

(72) Inventors: Johann F. Graf, Gumpoldskirchen (AT); Tomasz Zajac, Cracow (PL)

(73) Assignee: Novomatic AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 16/116,996

(22) Filed: Aug. 30, 2018

(65) Prior Publication Data

US 2018/0374299 A1 Dec. 27, 2018

Related U.S. Application Data

(60) Division of application No. 15/138,266, filed on Apr. 26, 2016, now Pat. No. 10,078,938, which is a (Continued)

(51) Int. Cl.
*A63F 9/24* (2006.01)
*G07F 17/32* (2006.01)

(52) U.S. Cl.
CPC ..... *G07F 17/3225* (2013.01); *G07F 17/3204* (2013.01); *G07F 17/3211* (2013.01); *G07F 17/3218* (2013.01); *G07F 17/3244* (2013.01)

(58) Field of Classification Search
CPC ..... A63F 13/3211; G07F 17/3225; G07F 17/3218; G07F 17/3204
See application file for complete search history.

(56) References Cited

U.S. PATENT DOCUMENTS 6,270,410 B1 * 8/2001 DeMar ..... G07F 17/32 273/143 R
8,133,102 B2 3/2012 Dabrowski
(Continued)

FOREIGN PATENT DOCUMENTS

CN 101997578 A 3/2011
EP 2549449 1/2013
(Continued)

OTHER PUBLICATIONS

Office Action for U.S. Appl. No. 14/200,474 dated Jun. 22, 2015; 11 pps.
(Continued)

*Primary Examiner* — Steve Rowland
(74) *Attorney, Agent, or Firm* — Fincham Downs LLC; Magdalena M. Fincham

(57) ABSTRACT

A system and method for controlling an electronic gaming machine ("EGM") from a mobile device during a remote access play session. The EGM is switched between a local access mode in which the inputs on the EGM are active and a remote access mode in which the inputs on the EGM are de-activated and a player interfaces the EGM using a mobile device such as a smartphone or a tablet computer. During remote access play sessions, all critical game play operations continue to be performed exclusively on the EGM and not on the mobile device. Critical game play operations include random number generation and determination of game outcome. Game content, including video, screenshot images and audio of the game is transmitted to the mobile device for display to the player. Player input and selections are made on the mobile device.

17 Claims, 14 Drawing Sheets

Related U.S. Application Data continuation of application No. 14/200,474, filed on Mar. 7, 2014, now Pat. No. 9,336,644.

(60) Provisional application No. 61/774,738, filed on Mar. 8, 2013.

(56) References Cited

U.S. PATENT DOCUMENTS

2006/0160614 A1* 7/2006 Walker ..... G07F 17/32 463/29
2006/0189382 A1* 8/2006 Muir ..... G07F 17/32 463/29
2008/0102916 A1* 5/2008 Kovacs ..... G07F 17/3211 463/16
2008/0311971 A1 12/2008 Dean
2010/0240435 A1* 9/2010 Gagner ..... G07F 17/32 463/20
2012/0058816 A1 3/2012 Wells
2012/0165101 A1* 6/2012 Krishnamoorthy ..... G07F 17/3223 463/42
2012/0315984 A1 12/2012 Carrico et al.
2013/0165210 A1* 6/2013 Nelson ..... G07F 17/3225 463/25
2013/0337878 A1* 12/2013 Shepherd ..... G07F 17/3223 463/11
2014/0113729 A1* 4/2014 Nelson ..... A63F 13/235 463/42
2014/0274306 A1* 9/2014 Crawford, III ..... G07F 17/3218 463/25

FOREIGN PATENT DOCUMENTS

WO WO03027970 4/2003
WO WO2007/149947 A2 12/2007
WO WO2008/157587 A1 12/2008

OTHER PUBLICATIONS

Final Office Action for U.S. Appl. No. 14/200,474 dated Oct. 5, 2015; 5 pps.
Notice of Allowance for U.S. Appl. No. 14/200,474 dated Jan. 8, 2016; 7 pps.
Office Action for U.S. Appl. No. 15/138,266 dated Jul. 18, 2017; 9 pps.
Notice of Allowance or U.S. Appl. No. 15/138,266 dated Jan. 18, 2018; 7 pps.
Notice of Allowance or U.S. Appl. No. 15/138,266 dated May 23, 2018; 7 pps.

* cited by examiner

SYSTEM AND METHOD FOR REMOTELY CONTROLLING AN ELECTRONIC GAMING DEVICE FROM A MOBILE DEVICE

The present application is a Divisional Application of U.S. application Ser. No. 15/138,266 filed on Apr. 26, 2016 in the name of Graf et al. and titled SYSTEM AND METHOD FOR REMOTELY CONTROLLING AN ELECTRONIC GAMING DEVICE FROM A MOBILE DEVICE; application Ser. No. 15/138,266 is a Continuation Application of U.S. application Ser. No. 14/200,474 filed on Mar. 7, 204 in the name of Graf et al., titled SYSTEM AND METHOD FOR REMOTELY CONTROLLING AN ELECTRONIC GAMING DEVICE FROM A MOBILE DEVICE and granted as U.S. Pat. No. 9,336,644 on May 10, 2016; Application Ser. No. 14/200,474 claims the benefit of U.S. Provisional Application No. 61/774,738 filed on Mar. 8, 2013. The entirety of each of these applications is incorporated by reference herein for all purposes.

RELATED CASE INFORMATION

This application is a continuation of U.S. application Ser. No. 14/200,474 filed on Mar. 7, 2014, which claims priority benefit from U.S. Provisional Application Ser. No. 61/774,738, filed Mar. 8, 2013 entitled *System and Method for Remotely Controlling an Electronic Gaming Device from a Mobile Device*, which are both incorporated herein by reference in their entirety.

COPYRIGHT

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer a variety of games such as mechanical spinning reel games, video spinning reel games, video poker games, roulette games, keno games and other types of wagering games that are commonly deployed at a casino for use by players. Playing a particular EGM requires the player to physically sit at the machine and place a wager on the outcome of the game. The player then interacts with the game during the game cycle to make selections as directed for different options until the game cycle ends with the game outcome being selected and displayed to the player. If the outcome is a winner, the player receives an award corresponding to the outcome.

To date, to actively play a game on an EGM, a player must be physically present at the EGM. Prior art exists for the use of mobile devices for certain interactions with an EGM. For example, United States Patent Publication No. 2012/0315984A1, which is incorporated by reference herein, describes the use of a mobile device for developing and maintaining customer loyalty in the casino, although the player is unable to control game play operation of an EGM directly from a mobile device. This publication describes a technique for playing wager-based video card or slot games where game content, including game outcomes are generated on a remote device such as a server, and sent to a mobile device for display. The publication provides a description of an EGM configured to receive at least game outcomes from a remote device (server) where the EGM itself does not use a random number generator ("RNG") to generate game outcomes locally. The game outcomes are instead generated remotely (from the server) in response to inputs made on the mobile device such as an input indicating a wager amount and/or an input to initiate the game. The wager amount or initiation information can be sent from the mobile device to a remote device such as from a mobile gaming device to a server. After receiving the game outcomes from the remote device (server), a game presentation for the game outcomes generated remotely can be generated and displayed on the mobile device. In some instances, the game presentation can also be generated remotely (from the server) and then streamed for display to the mobile device. (See Paragraph [0092] of 2012/0315984A1).

SUMMARY

The present invention overcomes the drawbacks of the prior art by providing a system and method of using a mobile device to remotely control an EGM where control may be switched between: (a) local control of the EGM by a player physically present at the EGM interacting with the EGM through the inputs on the EGM; and (b) remote control of the EGM by a player using a mobile device such as a smartphone or tablet computing device.

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

DETAILED DESCRIPTION OF THE INVENTION

Figure 1:
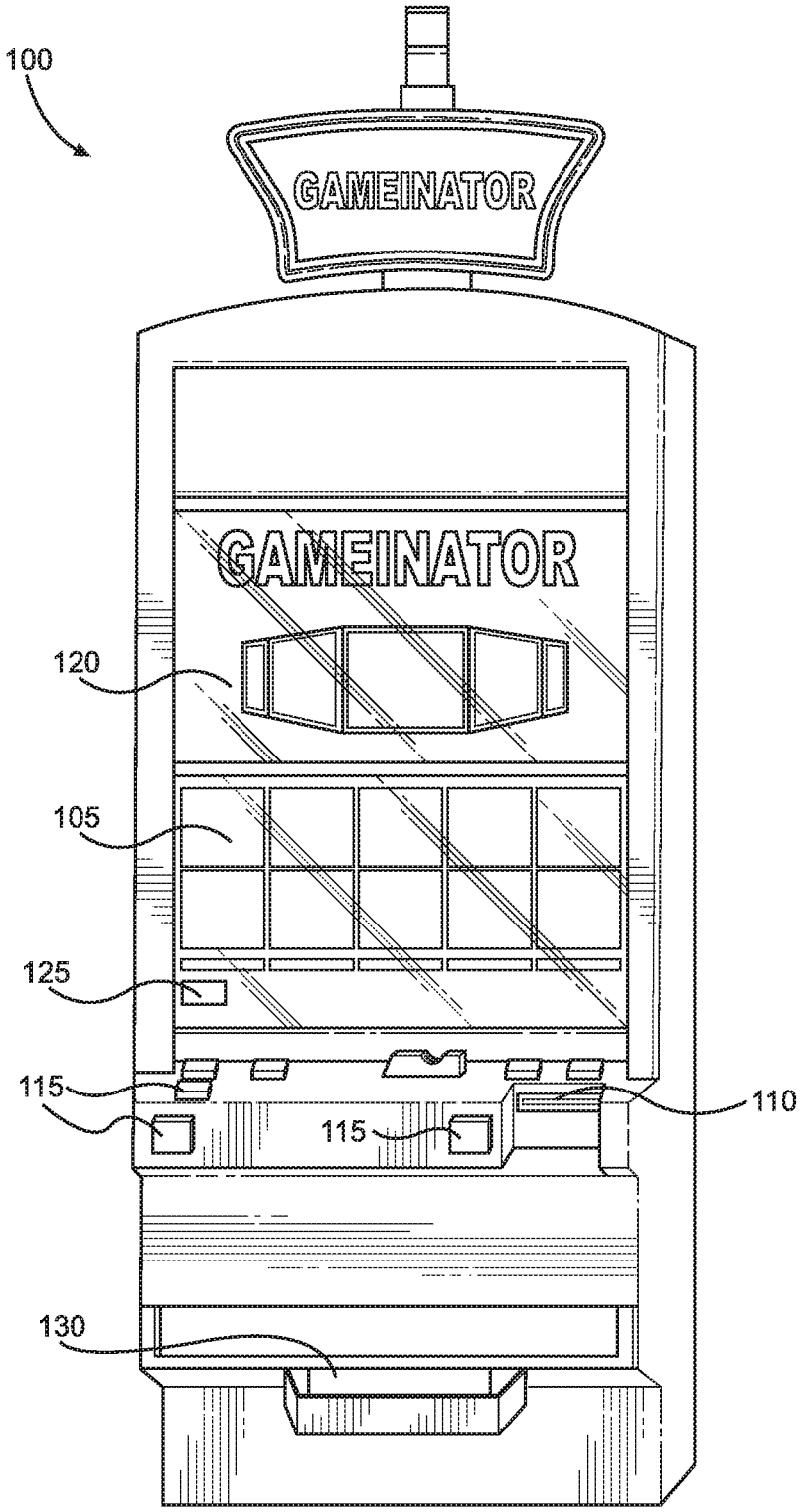
FIG. 1 Prior Art
FIG. 1 shows an electronic gaming machine for playing a game of chance.

The present invention will now be described in more detail with reference to the accompanying drawings. It should be understood that the invention may be embodied in many different forms and should not be construed as limited to the embodiments set forth herein. Throughout FIGS. 1-12, like elements of the invention are referred to by the same reference numerals for consistency purposes.

FIG. 1 shows an electronic gaming machine ("EGM") 100 with a number of components. A primary display 105 is used to show game play and resulting outcomes, and may be in the form of a video display (shown), or alternatively, physical reels. Touch screen displays are included on most EGMs and provide a flexible interface for operation of EGM 100, including displaying symbols during game play. Other components include a bill validator (see FIG. 2) housed inside EGM 100 into which bills may be inserted through bill slot 110. Buttons 115 on the exterior of EGM 100 are used to initiate and control EGM operations in conjunction with touch screen display 105 by the player. EGMs may further include a secondary display 120 for displaying other game functions including bonus screens. Either of primary display 105 or secondary display 120 may be used to show information to the player such as pay tables, messages, advertising, entertainment screens or other types of information. Multiple meters 125 on display 105 are used for tracking credits available for play, amount won on a particular play, number of coins bet and other amounts are typically positioned near the bottom of screen 105. EGM 100 may also accept coins. In those cases, a coin tray 130 at the bottom of EGM 100 is used to catch coins as they are dispensed to a player.

It is common for EGM 100 to include a ticket-in, ticket-out ("TITO") component that includes a ticket reader and ticket printer housed inside of EGM 100 that may accept bar coded credits printed on a ticket through slot 110 and for which the value of the credits is displayed on meters 125 upon a ticket being inserted.

Figure 2:
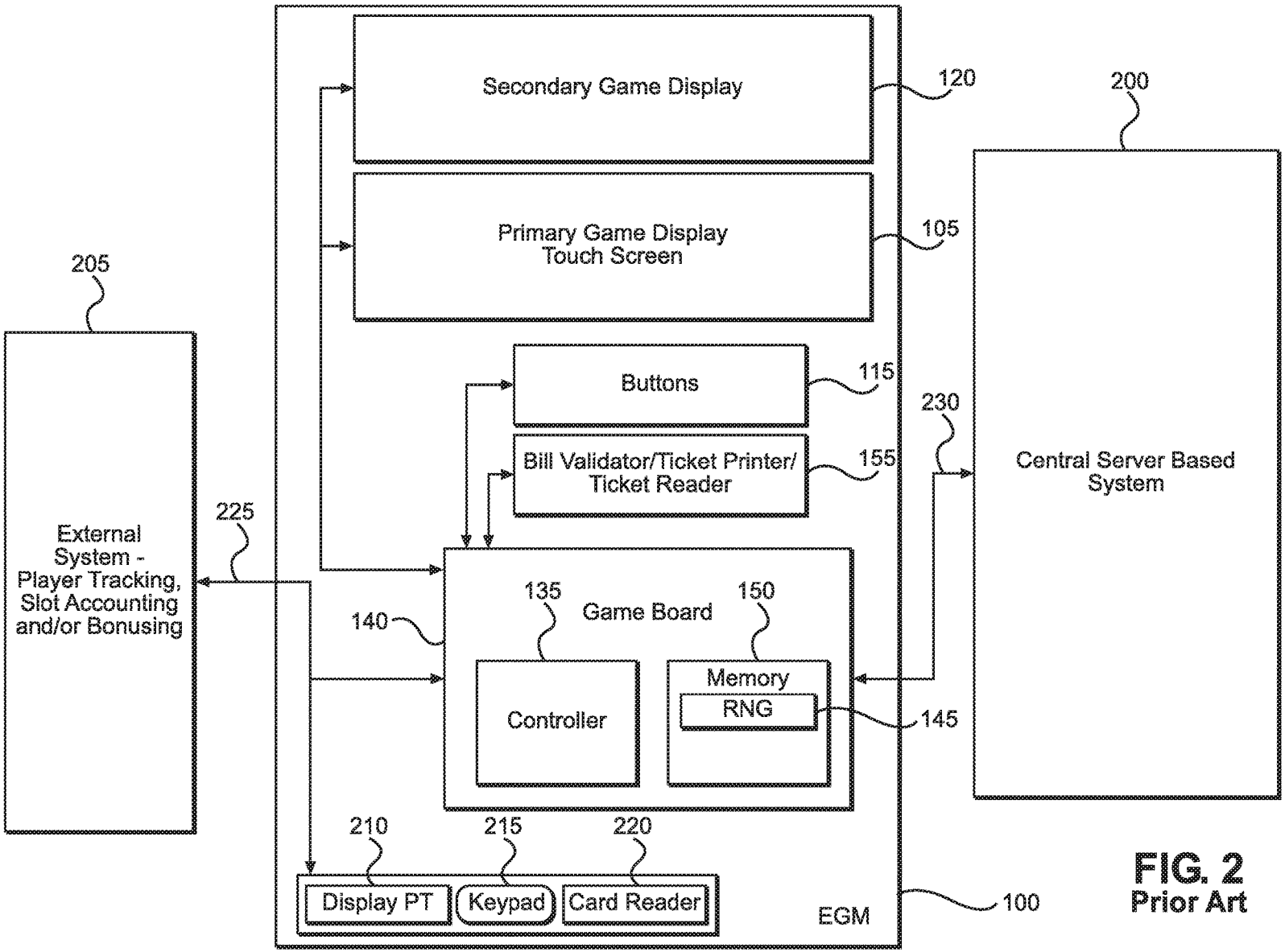
FIG. 2 Prior Art
FIG. 2 shows a block diagram of an electronic gaming machine for playing a game and connected to a network controlled by a central server based system with an external system also connected to the network.

FIG. 2 is a block diagram of EGM 100 connected to a central server based system 200 and showing certain internal components of EGM 100. All operational functions of EGM 100 are controlled by a controller 135 such as a microprocessor housed inside EGM 100 that is resident on a game board 140. The controller executes instructions that include operation of an EGM based random number generator 145 ("RNG") that is typically implemented in software and stored in a memory 150. Alternatively, a true hardware random number generator may be used. The internal components of EGM 100 are well known to those of ordinary skill in the art. Game outcomes are determined based on the random numbers selected by RNG 145. A bill validator 155 for accepting paper currency is shown integrated with a ticket reader and ticket printer. Bill validator 155 accepts currency in the form of bills or tickets from a player and adds credit to meters 125 on EGM 100. A camera 160 may also be included in EGM 100 for the purpose of recording images of game play and game operations on either or both of screens 105 and 120. Camera 160 is preferably capable of capturing both video and still images.

An external system 205 such as a player tracking system, a slot accounting system or a bonusing system may also be connected to EGM 100. These types of systems are typically connected to EGM 100 either through a separate interface board (not shown) or directly to different components of EGM 100 including but not limited to game board 140. A player tracking system may also include other components installed in EGM 100 such as a player tracking display 210, a keypad 215 and a card reader 220. These components allow for direct interaction between external system 205 and the player to receive information from the player on keypad 215 or through information on a card inserted into card reader 220, and to display information to the player on display 210. A network is established between external system 205 and EGM 100 by network connection 225. The network may be connected to all EGMs 100 in a casino or any smaller subset of EGMs 100.

Server based system 200 is also connected to EGMs 100 by a network connection 230 which may be on a separate network or the same network as the one connecting EGM 100 to external system 205. Server based system 200 may be a single server or it may represent a group of interconnected servers that are configured to be a single system interfacing with a group of EGMs.

It will be understood that the type of networks 225, 230 over which data is communicated can be one of several different types of networks. These include a Local Area Network (LAN), Wide Area Network (WAN), an intranet, the internet or other classes of networks. Any type of network technology could be used without departing from the principles of the invention. This would include communication via any protocol on any of the layers of the OSI model (ISO/IEC 7498-1) with or without encryption (e.g. SSL encryption, VPN, etc). The time is synchronized on all components of the system via a network protocol such as, for example, network time protocol ("NTP") to ensure that time stamps may be reliably compared.

Figure 3:
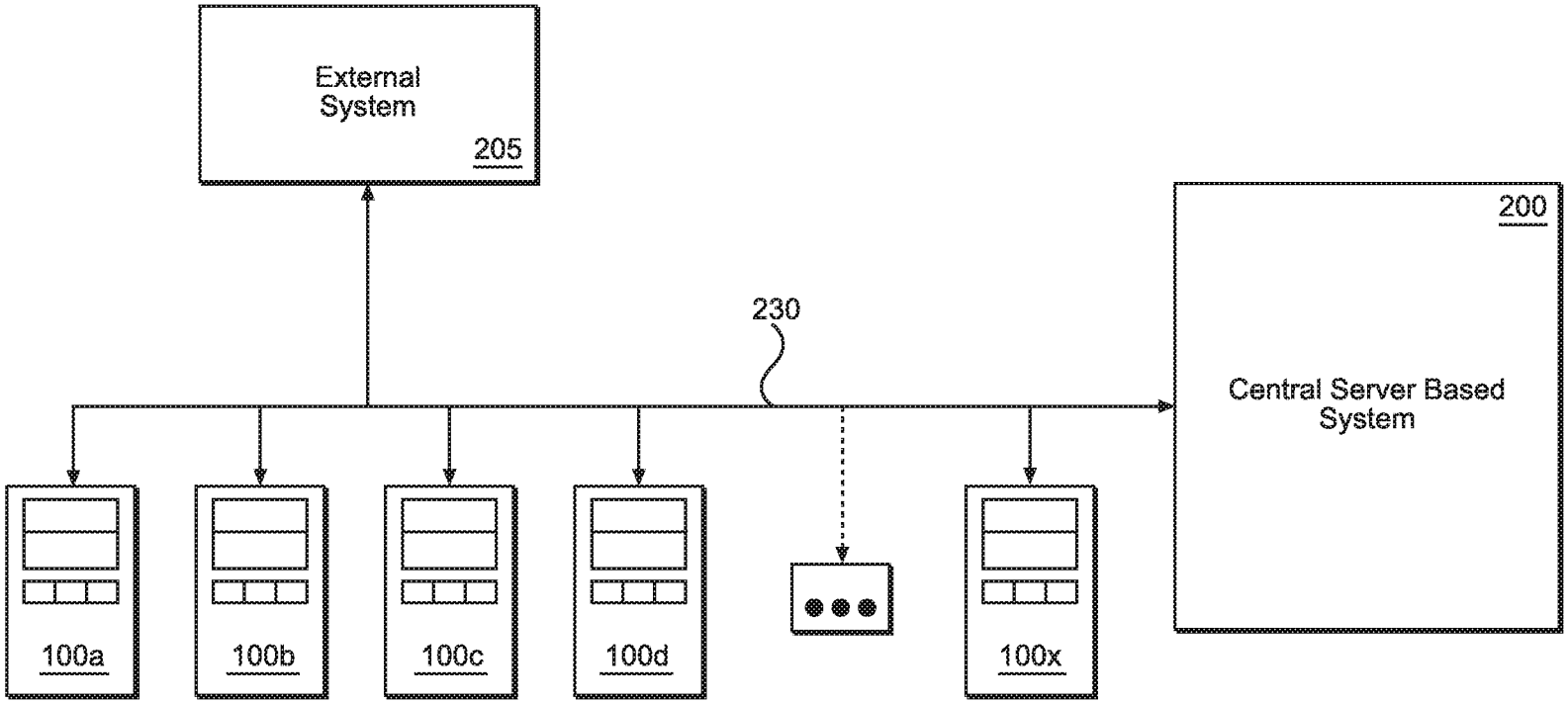
FIG. 3 Prior Art
FIG. 3 shows a block diagram of a group of electronic gaming machines on a network connected to a server based system and an external system.

FIG. 3 is a block diagram showing a group of EGMs 100*a-x* on a network connection 230 between central server based system 200 and each of EGMs 100*a-x*. It should be understood that the network may be set up with any number of EGMs that may be in the thousands of machines. Each of EGMs 100*a-x* is also connected to external system 205 that may be a player tracking, slot accounting, bonusing or other type of system.

Figure 4B:
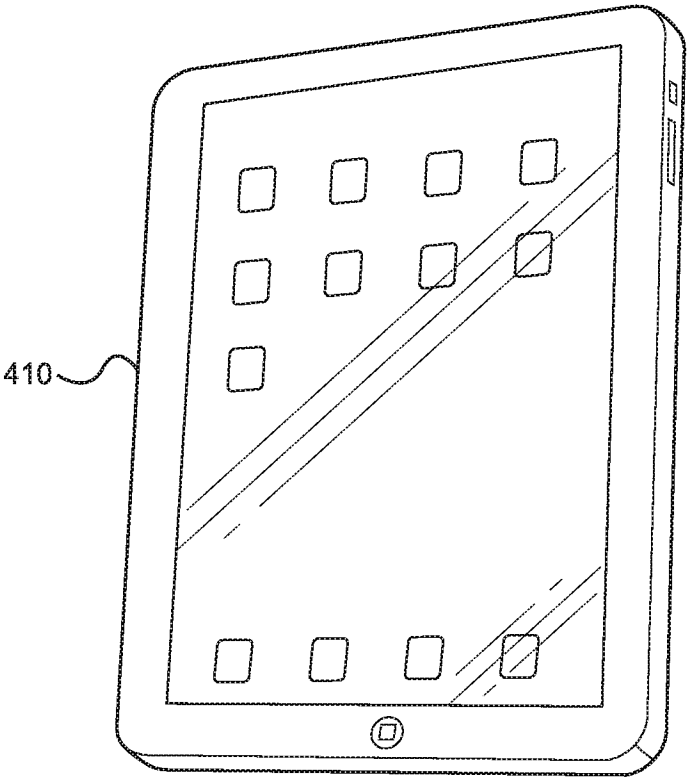
FIGS. 4A-4B show examples of mobile devices.
Figure 4A:
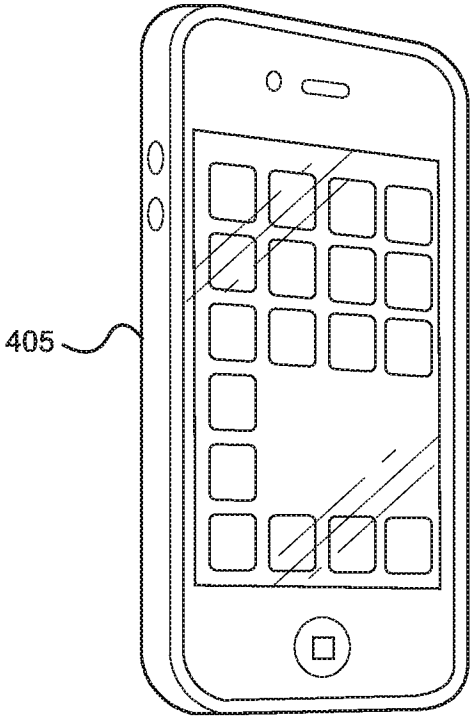

FIG. 4A and FIG. 4B show mobile devices that may be used to remotely control EGM 100. FIG. 4A is a smartphone 405 such as an iPhone® sold by Apple® while FIG. 4B is a tablet computing device 410 such as an iPad® sold by Apple®. Either of these devices as well as other mobile handheld devices may be used to remotely access and control EGM 100 once EGM 100 is placed in a remote access mode. For ease of reference in this description, a mobile device will be generally referred to as mobile device 405. However, it should be understood, that mobile device 405 may be substituted with mobile device 410, or any other electronic device with communicative connection capabilities that is remotely located from EGM 100 and from which EGM 100 may be controlled. Such devices may include a dedicated remote electronic gaming device specially designed and produced for remote gaming purposes, a laptop computer, a portable video gaming device such as an PlayStation Portable, or PSP®, sold by Sony®, or any other general computing device that may be programmed or loaded with application software to provide the necessary capabilities for remotely controlling EGM 100.

Figure 5:
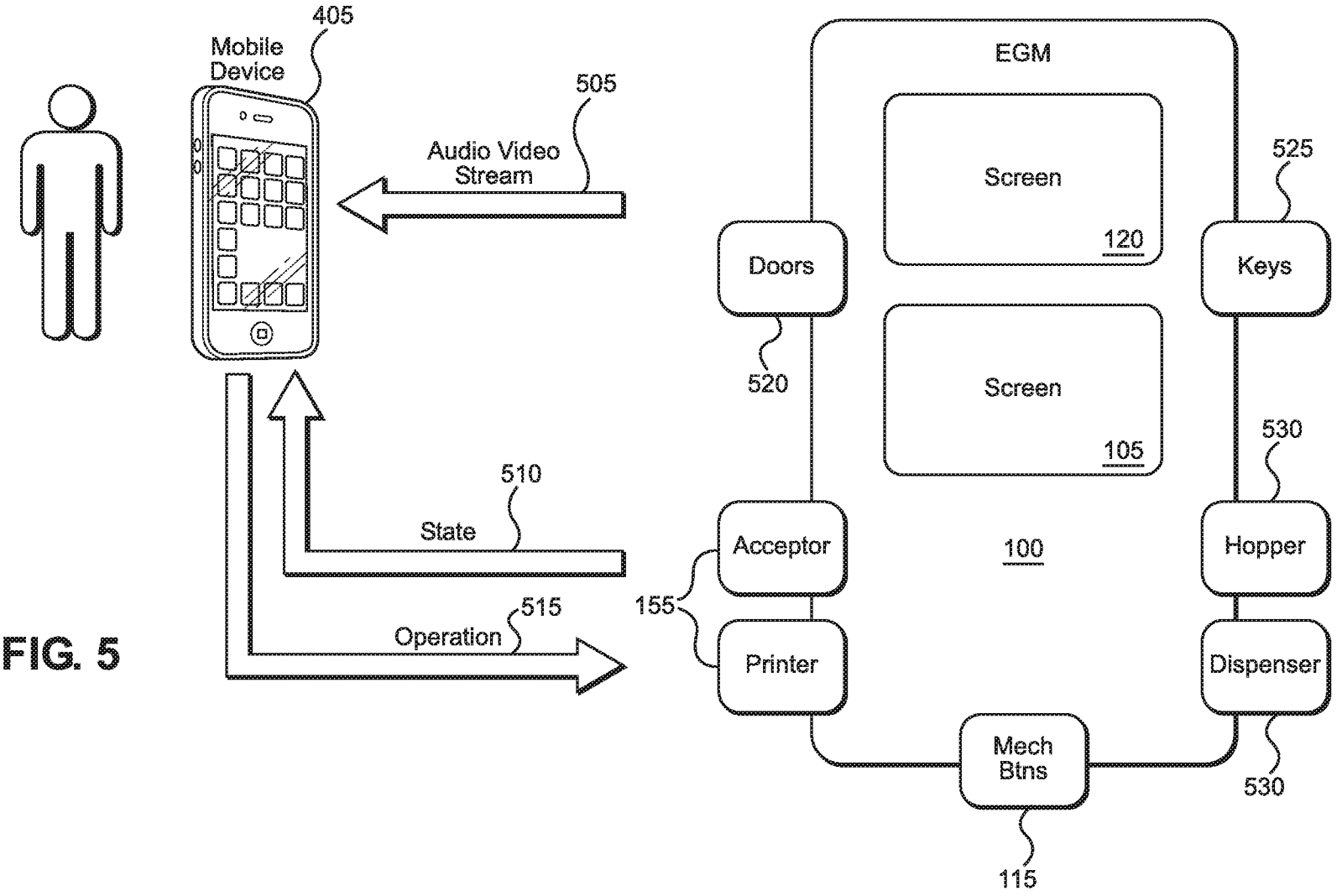
FIG. 5 is a block diagram showing communication between a mobile device and an EGM.

FIG. 5 is a block diagram showing communication between a mobile device 405 and an EGM 100. To enable remote control, a player interacts with EGM 100 on mobile device 405 using multi-channel communication. Actions are performed using physical buttons such as touchscreen 105 or buttons 115 on EGM 100 and the touchscreen or buttons on mobile device 405. Actions include, but are not limited to the transfer of funds, game selection, switch to activate remote control by the mobile device and return local control to the EGM, along with all other functions required to play a game and receive credit for player loyalty rewards. The multi-channel communication allows for transmission of game content including streaming video screen states, individual JPEG screen states, and/or text messaging, as well as audio to be transmitted between EGM 100 and mobile device 405. Throughout the process, all gaming functions are performed by EGM 100 with status of those actions transmitted to mobile device 405 for display to the player. The player interacts with EGM 100 by responding when necessary using inputs on mobile device 405. Since the gaming functions are performed on EGM 100, there is not an opportunity for a compromise of data or security on mobile device 405, which merely acts to display information to the player and provide responses from the player when necessary and is in physical lock-out mode while EGM 100 is under remote control by mobile device 405. Critical gaming functions such as running the RNG and determining game outcomes are handled exclusively by the internal components of EGM 100 irrespective of whether EGM is in local mode or remote access mode.

To ensure a secure connection between EGM 100 and mobile device 405 during a remotely controlled play session, a communication channel must be established between EGM 100 and 405. A mobile device 405 is able to identify a particular EGM by, for example, scanning a quick response code ("QR"), bar code, radio frequency ("RF") identification tag, or another code type that is detectable by a mobile device and displayed or detectable on or near the exterior surface of EGM or on one of the screens 105, 120 of EGM 100. Once mobile device 405 has the QR code, it can specify the particular EGM with which to establish communication. In an alternative embodiment, the identification code representing respective EGMs may be provided by means of an RFID tag attached to the EGM from which the mobile device may be adapted to read or detect identification information using an RFID communication protocol.

It should be understood that a specific identification code (which is encoded into QR or another code type) is associated with a particular EGM. It is a form of a certificate that is unique to the particular EGM and is paired with the EGM IP address in the remote play management system (see FIG. 12). The identification code is attached to the EGM housing and linked with the EGM, including a visible indicator on the outside of the EGM housing so that a player can see the code. The displayed code should also include a corresponding human readable form that can also be displayed on the screen of the mobile device for the player to confirm that the established connection is with the desired EGM.

Only authorized or registered mobile devices are enabled to access the EGM for private remote play using the network, which may be for example, be a WiFi network. The RF link between the EGM and the WiFi network may be permanently enabled or "on" so that when a mobile device accesses the WiFi network, the scanned QR code of the EGM that the player wants to remotely access may be used to link the mobile device and the EGM. Once the identification code is scanned, the link may be established without login since the mobile device has been authorized for use on the network by the gaming operator in advance of establishing the link between the EGM and the mobile device. Or, a login procedure may be required for additional security.

To start remote play on a mobile device, the player initiates a connection request from the mobile device. The mobile device is used to scan a particular EGM for the unique identification code that is transmitted to the remote play management system. The remote play management system checks the EGM registry to look up the identification code. If the EGM is found and remote access is not blocked for any reason, the remote play management system enables the remote play session for the mobile device. All mobile device requests are routed to the EGM and responses from the EGM are routed back to the mobile device.

Once a player has decided to end a play session, the player presses an end play button on the mobile device. The mobile device scans the identification code again and a disconnect signal is sent to the remote play management system. The remote play session is then closed by the remote play management system.

Once a communication channel is established between EGM 100 and mobile device 405, which may use Bluetooth, WiFi, near field communication ("NFC") or any other communication linking format, transmission of data between EGM 100 and mobile device 405 may be carried out to send an audio/video stream 505 from EGM 100 to mobile device 405. The protocol is used to format transmissions which include video, images and audio. The protocol may be any standard protocol such as real-time transport protocol ("RTP") over user data protocol ("UDP") or an MPEG protocol such as MPEG2 video encoder. Any other codecs or protocol may be used including a proprietary protocol specifically designed for EGM-mobile device communication. In one embodiment, an encoder known as VideoLAN x264 encoder may be used in view of this protocol having very low latency for video streaming. Transmission of the state of EGM 510 is also transmitted from EGM 100 to mobile device 405. This may include messaging related to the availability of EGM 100 for play, the timing of game play, a waiting state indicating that EGM 100 is awaiting an input from the user or other messages related to EGM components such as acceptor/printer 155, buttons 115, screens 105, 120, doors 520, keys 525, or hopper/dispenser 530 on EGM 100. Operational instructions 515 are sent from mobile device 405 to EGM 100 to provide user input, a request to use EGM in remote mode, request to terminate remote mode or other user instructions.

Figure 6A:
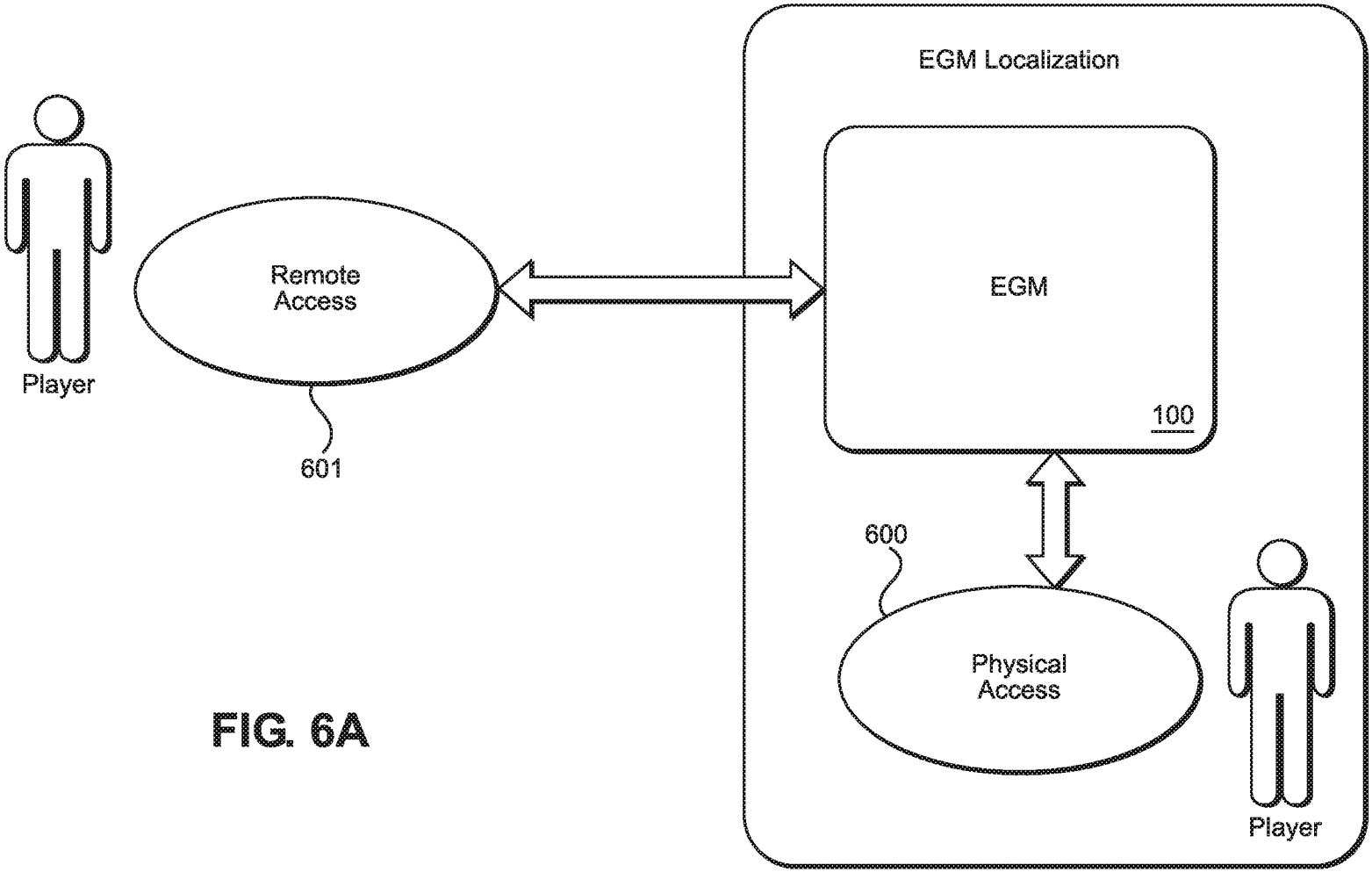
FIG. 6A is a block diagram of an EGM showing local and remote access options.

It should be understood that EGM 100 may switch between local access by a player physically playing EGM 100 directly at EGM 100 and remote access by a player playing through mobile device 405. This concept is shown in FIG. 6A showing the options of local access 600 and remote access 601.

Figure 6B:
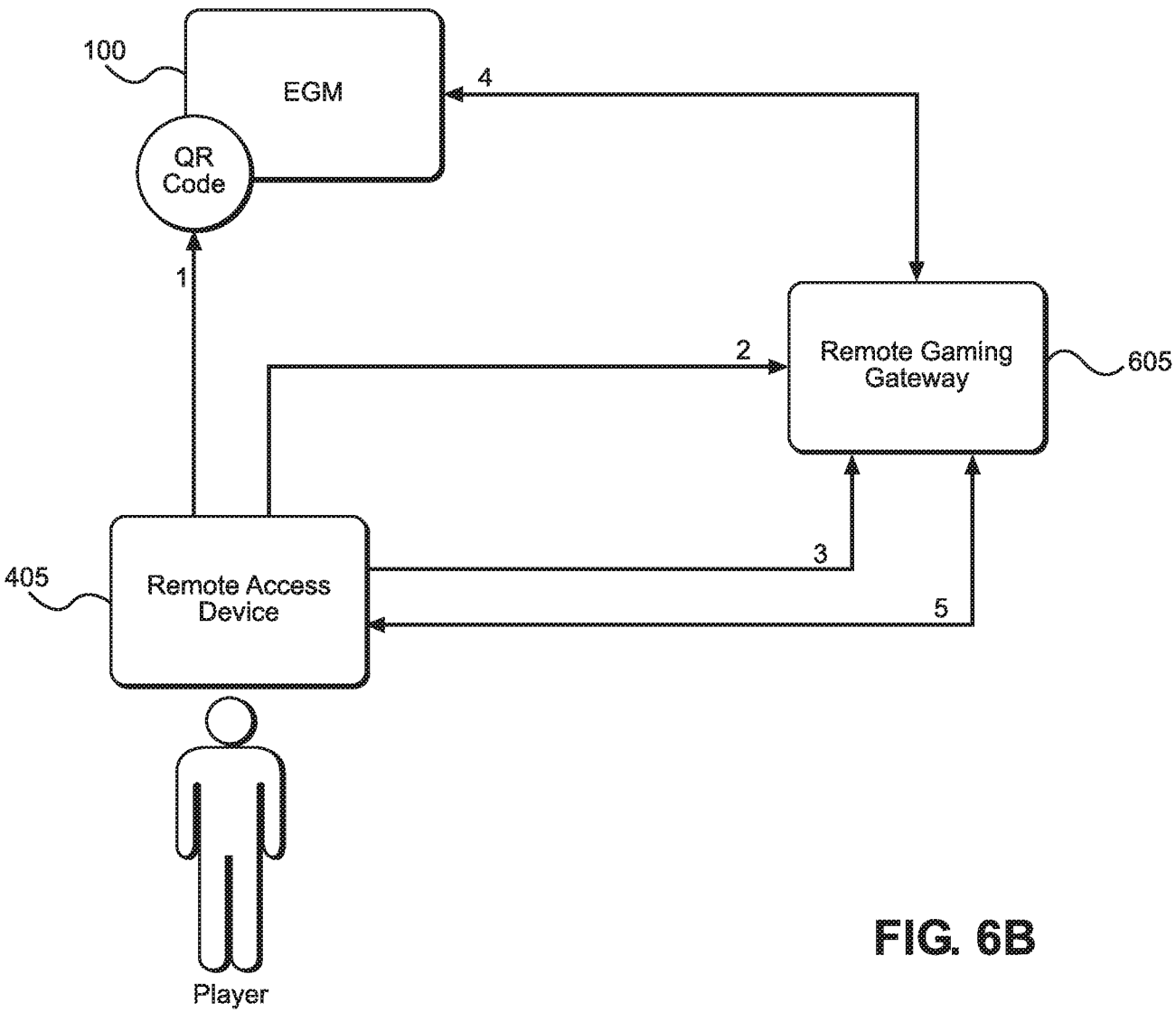
FIG. 6B is a block diagram of mobile device and an EGM connected using a remote gaming gateway.
Figure 6C:
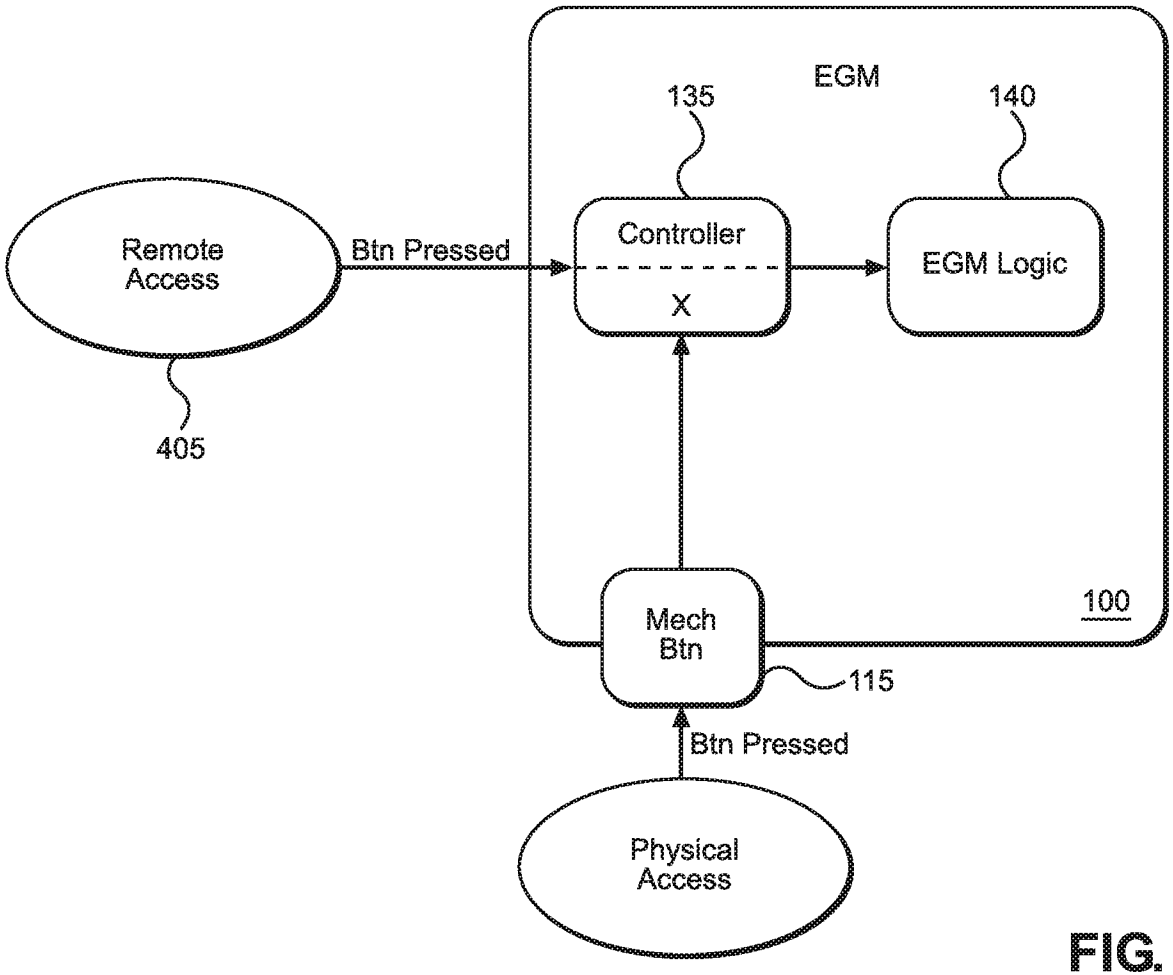
FIG. 6C is a block diagram of an EGM that may be switched between remote access using a mobile device and local access by physically playing at the EGM.

Once a communication connection is established between EGM 100 and mobile device 405, a gateway 605 (or a proprietary connection service referred to as LightBridge™ or LightBridge™ service developed by the assignee of this application) as shown in FIG. 6B is deployed to switch modes between local access on EGM 100 and remote access on mobile device 405. Gateway 605 is controlled by EGM controller 135, or a separate controller 135 as shown in FIG. 6C that is used for the purpose of running gateway 605 and controlling the connection between EGM 100 and mobile device 405. Upon establishing the connection, all signals from the buttons 155 and other inputs on EGM 100 are blocked and only gateway signal transmissions are propagated. As can be seen in FIG. 6B, initially, the QR code is scanned by mobile device 405 and a signal is sent to EGM 100 to switch from local operation mode to remote access mode at step 1. Gateway 605 is then notified of the switch after receiving a signal from mobile device 405 at step 2, and mobile device 405 then initiates a play session at step 3 that establishes two-communications between EGM 100 and gateway 605 at step 4, and between mobile device 405 and gateway 605 at step 5.

Figure 7:
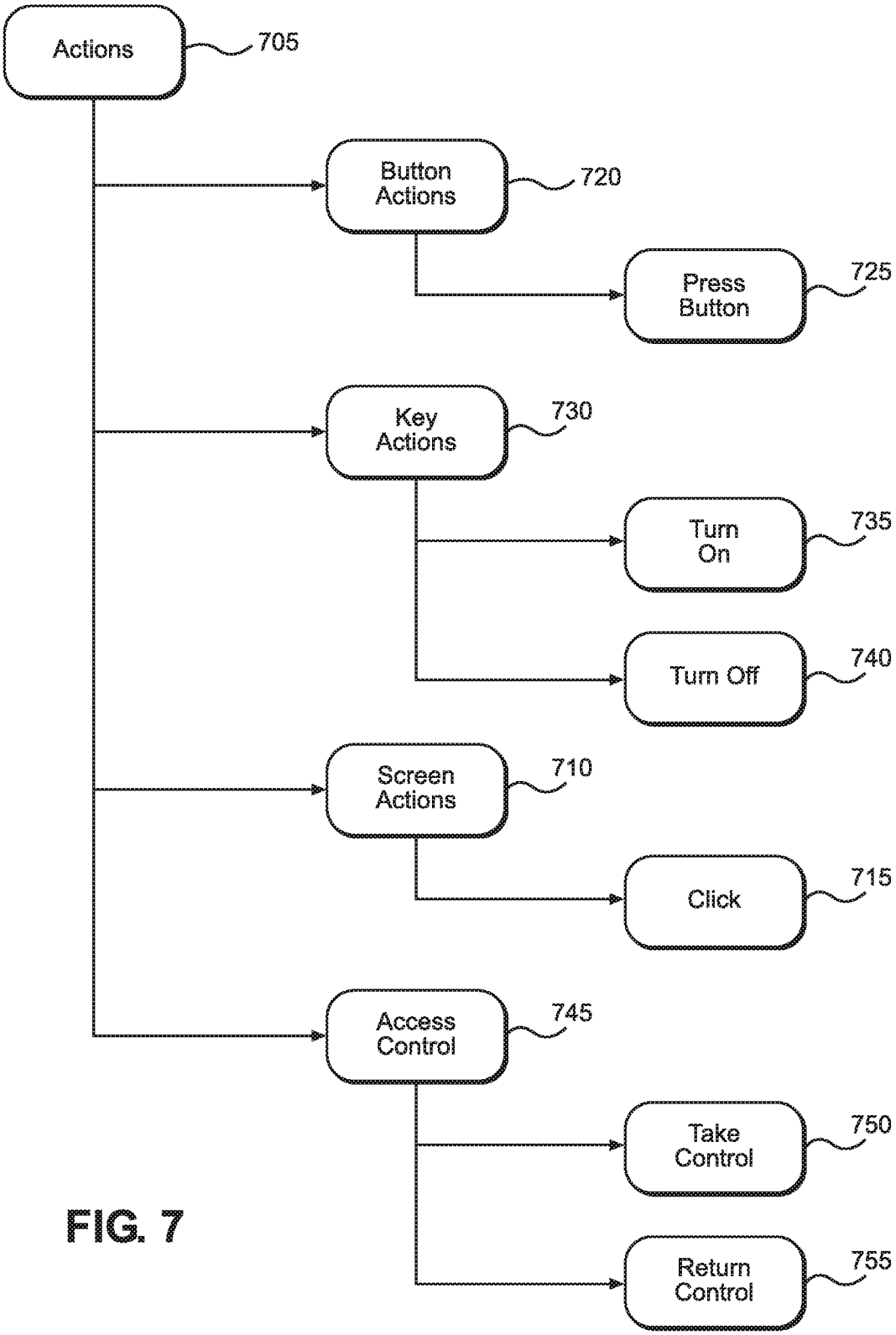
FIG. 7 is a flowchart of a hierarchy of actions available on the EGM.

Once in remote access mode, a hierarchy of actions 705 becomes available, an example of which is shown in FIG. 7, where actions can be executed by the player on mobile device 405 which are propagated to EGM 100. Screen actions 710 on mobile device 405 are activated by touchscreen clicks 715 and use of the mechanical button actions 720 performed by pressing button 725 on mobile device 405 are implemented during game play by EGM 100. Using software applications developed for a smartphone, tablet or other mobile device for use with the gateway, it is possible to specify any button functionality on a touchscreen or physical buttons on mobile device 405. Key actions 730 performed on a keyboard (not shown) on mobile device 405 can turn on 735 or turn off 740 a particular functionality. Similarly, access control 745 can be turned on 750 or turned off 755 using any of the user interface options previously described (e.g. touchscreen clicks, button depressions, keyboard actions).

Figure 8:
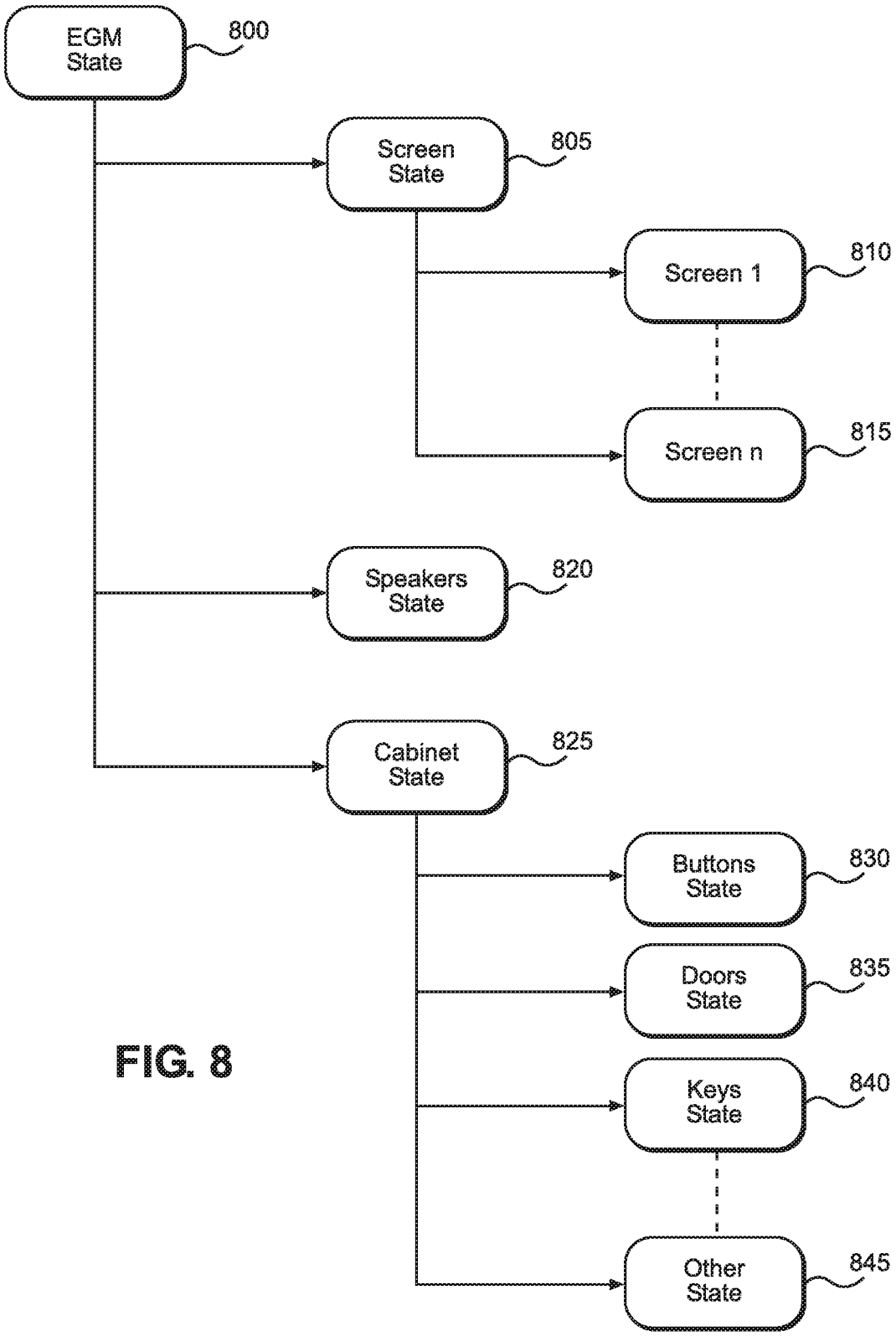
FIG. 8 is a flowchart of the states that an EGM may be in during operation.

An example of the possible states 800 of EGM 100 are shown in FIG. 8. The states 800, or a subset thereof, may be propogated from EGM 100 to mobile device 405, which is adjusted according to the states. This may happen at any time appropriate within the session. A set of touchscreen buttons displayed on the touchscreen of mobile device 405 reflect the particular screen state 805 as being screen 1 (810) to screen n (815). The screen states cover any given time and provide the player with the opportunity to make selections with respect to input and interaction with EGM 100. The states of these buttons are configured to simulate the states of EGM buttons 115 during play. It should be understood, that for smaller screens, it may be required or desirable to show only certain subgroups of buttons on the touchscreen of a mobile device at any given time, particularly if the mobile device is a smartphone. For a larger device like a tablet or laptop with a larger screen, it may be possible to show the screen of EGM 100 as it would appear on touchscreen 105 at any particular time. In that case, all buttons may be shown, while some may be operational or not depending on the input required at that point in the game play cycle.

Similar to screens state 805, the state of the speakers 820 on EGM 100 is also propagated to mobile device 405. However, for speakers, state 820 in the present case is simply whether there is audio being played or not without any additional states.

As described earlier, messages related to other functionality on EGM 100 may also be communicated to mobile device 405. For example, the state of the cabinet 825 may provide indications related to the state of buttons 830, doors 835, keys 840 and any other components 845 on EGM 100.

Figure 9:
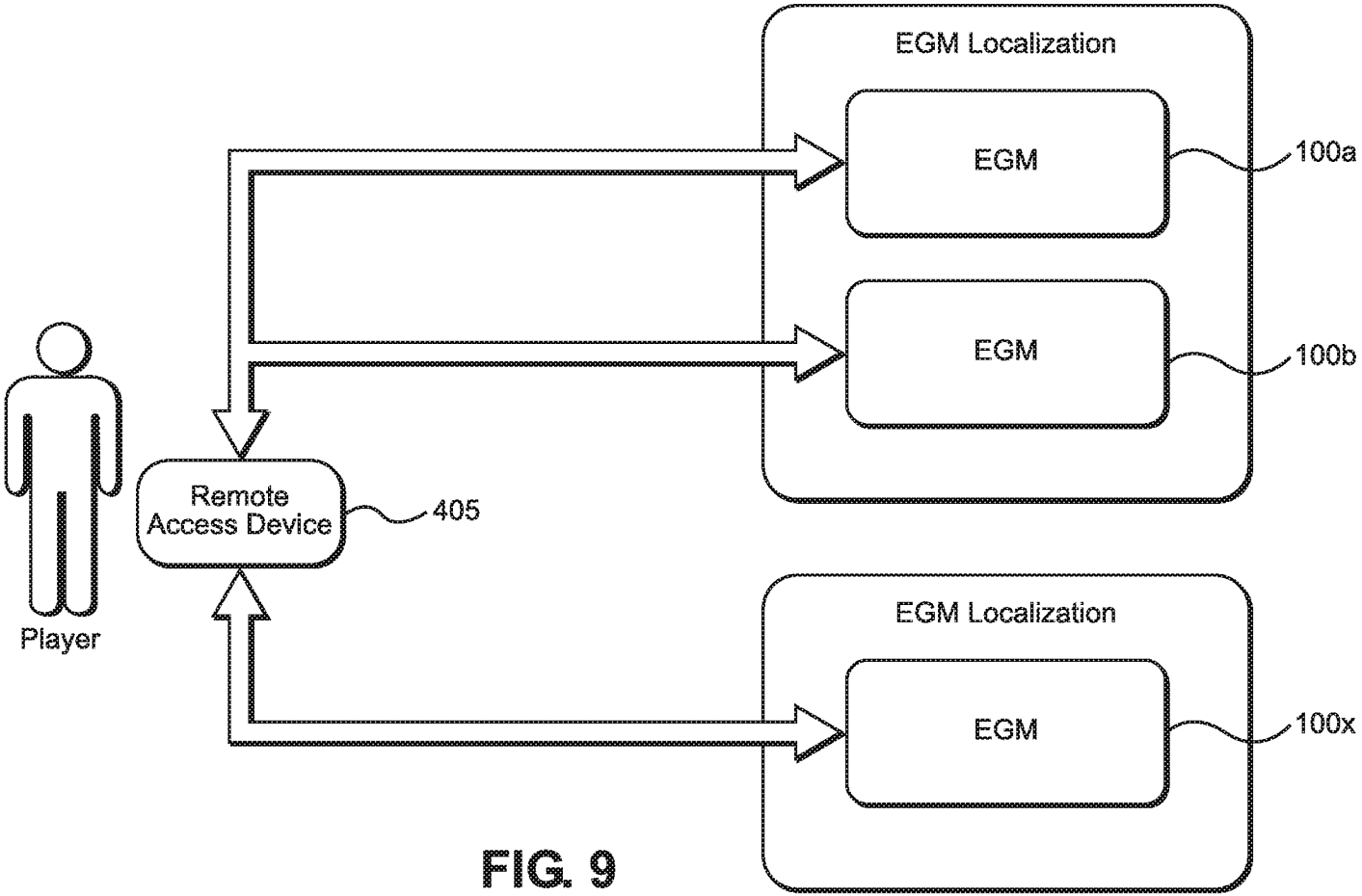
FIG. 9 is a block diagram showing a mobile device in parallel play on multiple EGMs.

FIG. 9 shows an embodiment in which multiple EGMs 100*a-x* may be controlled simultaneously, or in parallel. In this case, the display of screens from each controlled EGM would be alternated on mobile device 405 as player input and the display of game outcomes is required. For the control of multiple EGMs simultaneously, it will be necessary to clearly indicate to the player the particular current screen and the game in play on each particular remotely accessed EGM that is being viewed at any given time. A selection screen may be provided on the mobile device 405 on which are arranged a number of icons, each icon representing a respective EGM being controlled. A thumbnail picture may be shown at each icon to represent a screen state of the respective EGM. Alternatively a miniaturized video stream may be shown.

Figure 10:
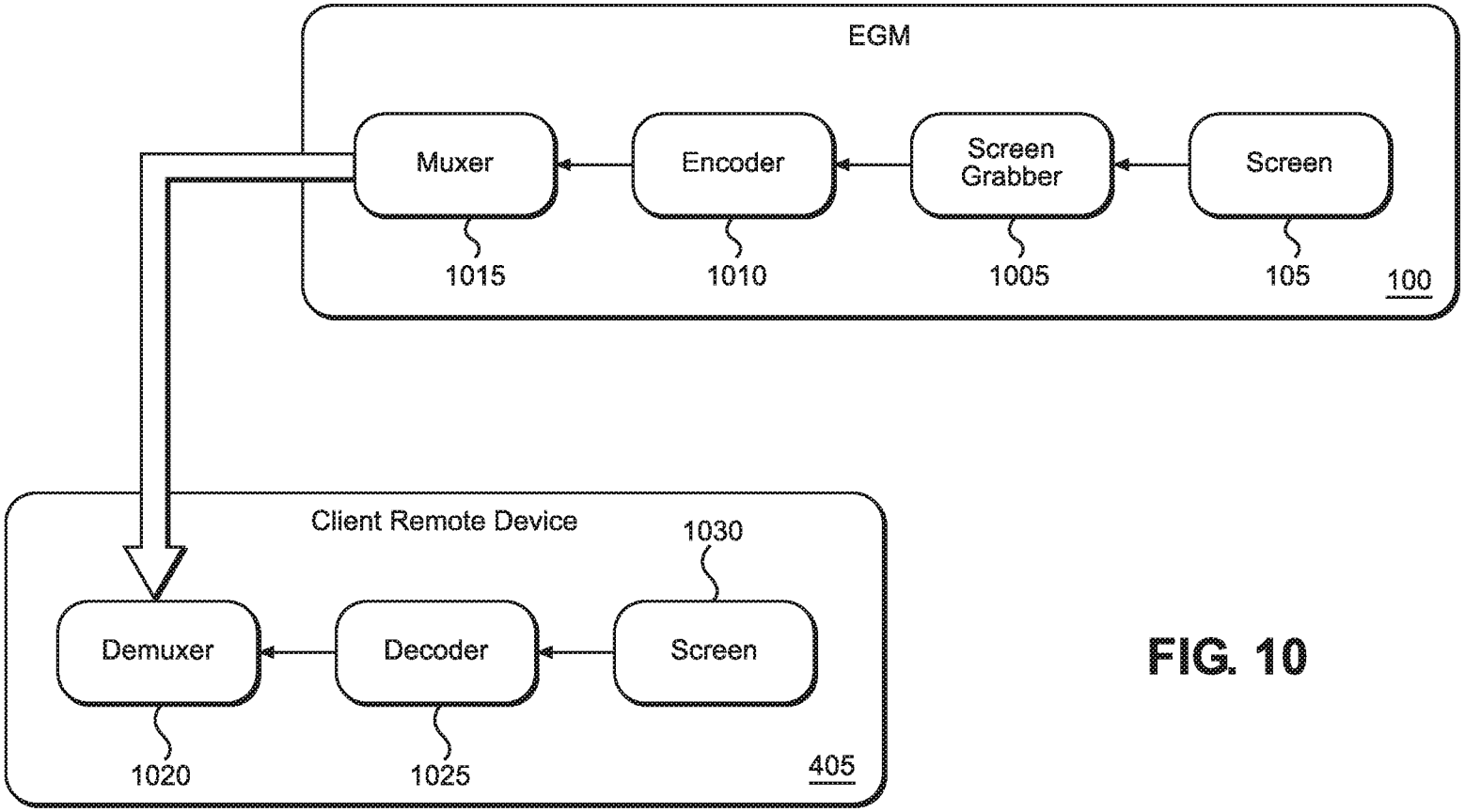
FIG. 10 is a block diagram showing the capture and transmission of screenshots from an EGM to a mobile device during remote play.

FIG. 10 is an embodiment where captured still image screenshots or streaming video of game play content may be in use. In the case of screenshots, EGM 100 sends screenshots of the particular game play screen to mobile device 405. In doing so, the image of a screenshot that in local operation mode on EGM 100 would be shown on screen 105 is captured by a screengrabber program or hardware 1005. The captured screenshot image is encoded by encoder 1010 and input to a multiplexer 1015 before it is transmitted to mobile device 405. Upon being received by mobile device 405, the image is input to a demultiplexer 1020 and decoded by a decoder 1025 before it is displayed to the player on screen 1030 of mobile device 405. Within EGM 100, the screenshot image for a video screen may be captured using a program to freeze the needed screenshot. A host of freely available screenshot programs are available for this purpose, or a proprietary program may be used. Also, a program for handling multimedia such as FFmpeg may be used to handle the image during processing while a media player such as FFmpeg+ may be used to display the image on screen 1030 of mobile device 405. In the event that it is necessary to capture a set of spinning reels at one or more particular points during the game play cycle as opposed to an image on a video screen, camera 160 positioned inside of the EGM cabinet may be used for this purpose.

In the case where streaming video of game play content is in use, it should be understood that the system works as described above for still image screenshots except that screenshots are taken continuously to generate a video. For example, screenshots may be captured sixty times per second. The individual frames are encoded into video using a video format such as mpeg2 video stream, h264 or any other video encoding format. The video is input to multiplexer 1015 which may combine video, audio and metadata into one stream that is then extracted by demultiplexer 1020 when the stream is received at mobile device 405.

Figure 11:
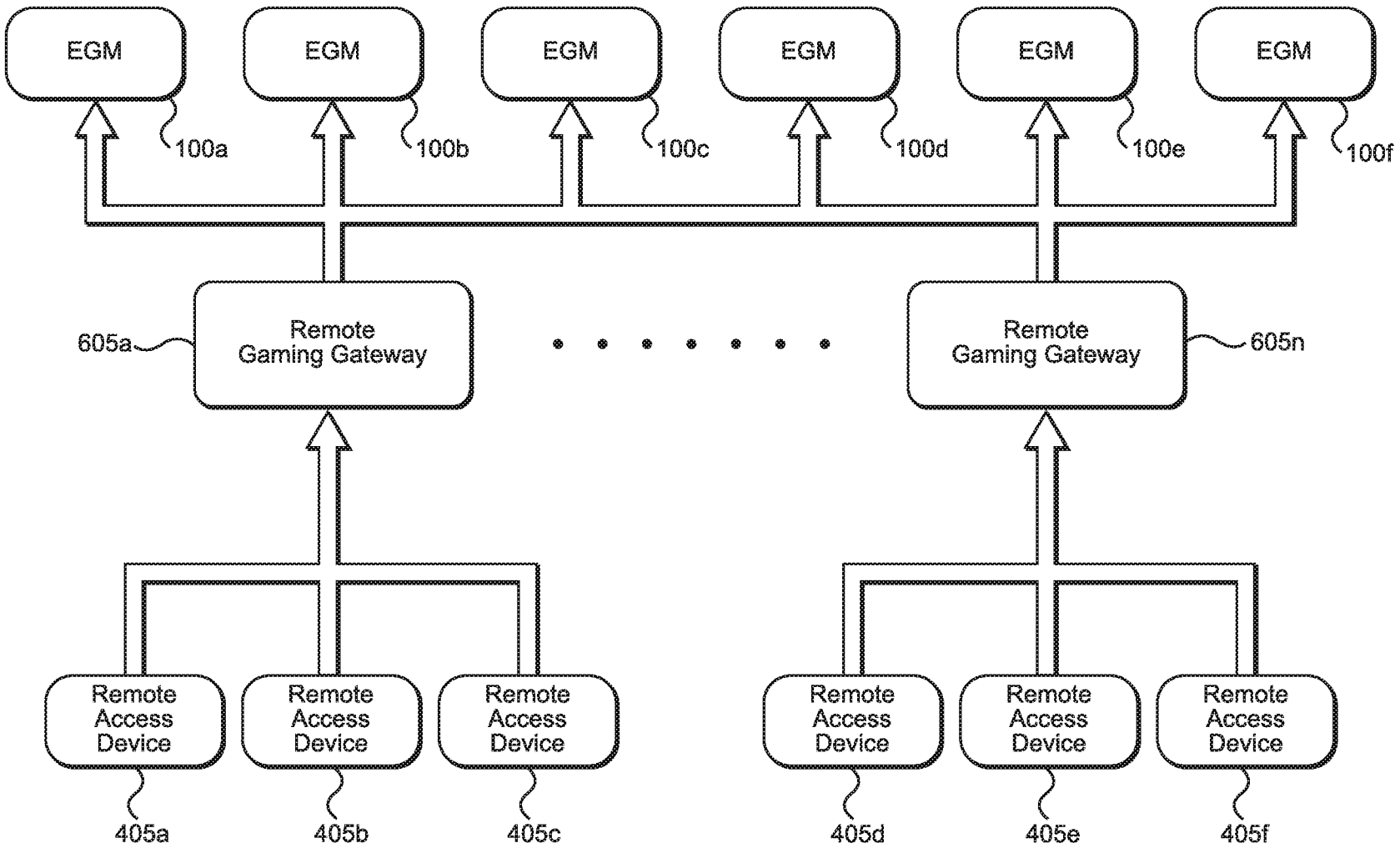
FIG. 11 is a block diagram of a group of electronic gaming machines on a network connected to a group of remote access devices through a group of gateways.

FIG. 11 is a block diagram of a group of EGMs 100*a-f* on a network connected to a group of remote access devices 405*a-f* through a group of gateways a-n. This diagram shows the scalability and flexibility of a system of EGMs connecting to remote access devices while routing communications through a set of gateways 605*a-n*. As can be seen in FIG. 11, it is not necessary for an individual gateway 605 to be employed for each EGM-mobile device pairing. Instead a single gateway 605 may handle communications for large numbers of EGM-mobile device pairings provided each session established between an EGM and a mobile device is handled according to the procedures described herein. When a particular gateway reaches capacity, a pairing is established at another gateway. It should be understood that for the greatest level of flexibility, any EGM 100 in the system may be paired with any mobile device 405 across any gateway 605 with all gateways being configured in the network to be connectable to any EGM 100 and any mobile device 405.

Figure 12:
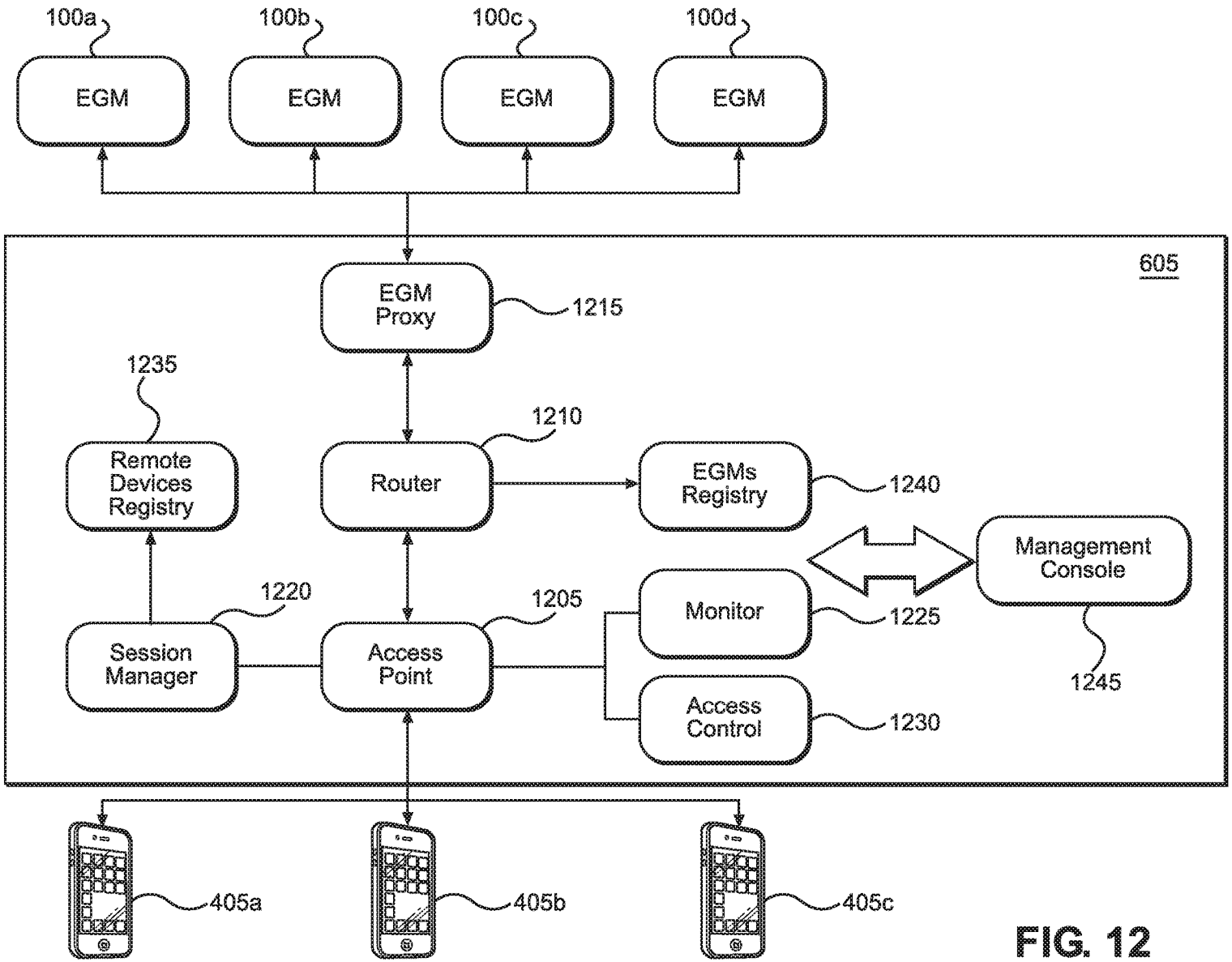
FIG. 12 is a block diagram of a group of electronic gaming machines on a network connected to a group of remote access devices together with a detailed view of the components of one gateway.

FIG. 12 is a block diagram of a group of EGMs 100*a-d* on a network connected to a group of remote access devices 405*a-c* together with a detailed view of the components of a gateway 605. Gateway 605 is responsible for remote play management by providing access control, session management and monitoring of the remote play activities. Gateway 605 includes a number of software components including access point 1205, router 1210, EGM proxy 1215, session manager 1220, monitor 1225, access control 1230, remote devices registry 1235, EGMs registry 1240 and management console 1250. The software components of gateway 605 forward, monitor and transform requests communicated between remote access devices 405*a-c* and EGMs 100*a-d*.

In operation, access point 1205 is the entry point for all communications flowing between a particular remote access device and a particular EGM. Router 1210 is used to determine which EGM has been selected to be connected to a particular remote access device and to route communications accordingly between those two devices. EGM proxy 1215 transforms the messages back and forth between the proprietary protocols used by EGMs 100 and remote access devices 405. Session manager 1220 manages the remote play session from beginning to end while monitor 1225 is responsible for monitoring the state of the system and access control 1230 controls access to the system from the particular remote access device in use. Remote devices registry 1235 holds a list of registered remote access devices 405 available on the system so that a connection may be established between a particular remote access device in use by a player and a selected EGM from all EGMs available on the system, a list of which is held in EGMs registry 1240. And, management console 1245 is a web-based application or other software interface that allows a system operator to access all aspects of the system software to manage operations and settings of the system, including for example, setting up remote access device registry 1235 and EGM registry 1240. Management console 1245 may also be used by an operator to track and review game play by players using remote access devices 405.

While the invention has been described with respect to the figures, it will be appreciated that many modifications and changes may be made by those skilled in the art without departing from the spirit of the invention. Any variation and derivation from the above description and drawings are included in the scope of the present invention as defined by the claims.

What is claimed is:

1. A system in which players play games remotely over a network, comprising:

at least one mobile device communicating on the network;

a plurality of electronic gaming machines ("EGMs") communicating on the network and configured to be controlled by the at least one mobile device in a remote access mode of operation, each EGM comprising:

a random number generator for generating random numbers that determine the outcome of the game and that correspond to a predefined set of game outcomes including winning and losing outcomes;

a display for displaying game play including game outcomes to a player;

a set of inputs on each EGM from which a player may interface with the EGM;

an EGM controller for controlling game play on each EGM;

a mode controller for switching exclusively between:

a local access mode in which a player interacts with a particular EGM using the set of inputs on the particular EGM; and a remote access mode in which a player interacts with the particular EGM using the at least one mobile device;

at least one gateway on the network, wherein a first gateway among the at least one gateway is configured to establish a pairing between a first mobile device among the at least one mobile device and each EGM of a first subset of EGMs among the plurality of EGMs, the first subset including more than one EGM, the first gateway being operable to propagate communication between the first mobile device and each EGM of the first subset of EGMs, wherein the player of the first mobile device is able to control in parallel each of the EGMs of the first subset via the first mobile device once the pairing is established;

wherein an output of screens from each EGM of the first subset controlled by the player is alternated on the first mobile device; and wherein the first gateway is further configured to establish pairings between additional subsets of EGMs among the plurality of EGMs and additional mobile devices among the at least one mobile device.

2. The system of claim 1 wherein each EGM among the plurality of EGMs further comprises an EGM remote session capture component for capturing game play and transmitting the game play, including game outcomes to the first mobile device during a remote session for display to the player.

3. The system of claim 2 wherein the game play content is provided in a form that comprises one or more among the group comprising: (a) screenshot images; (b) video content; or (c) audio content.

4. The system of claim 1 wherein any mobile device among the at least one mobile device is pairable with any EGM among the plurality of EGMs in the system.

5. The system of claim 1 wherein the first mobile device displays game states on a screen of the first mobile device and buttons operable by the player corresponding to a particular state of the game.

6. The system of claim 1 wherein a user interface on the at least one mobile device detects screen size of the at least one mobile device and adjusts game functions displayed to the player during remote play on the at least one mobile device.

7. The system of claim 1 wherein the at least one mobile device is one of a group of electronic devices from the group including: (a) a smartphone; (b) a tablet computer; (c) a laptop computer; (d) a portable video gaming device; and (e) a dedicated device on which a player may access an EGM in the remote access mode.

8. The system of claim 1 wherein each EGM among the plurality of EGMs further comprises an identification code and further wherein any mobile device among the at least one mobile device initiates a remote access mode session by reading the identification code and transmitting a signal to each EGM of the first subset of EGMs including the identification code requesting that a particular EGM of the first subset of EGMs initiate a remote access mode session.

9. The system of claim 8 wherein the identification code is of a type from the group comprising: (a) a quick response code ("QR"); (b) a bar code; (c) a RF identification tag; or (d) another code that is detectable by the at least one mobile device.

10. A method of enabling remote play of games over a network, comprising:

providing at least one mobile device communicating on the network and configured to control an electronic gaming machine ("EGM") in a remote access mode;

providing a plurality of EGMs communicating on the network, each EGM comprising:

a random number generator for generating random numbers that determine the outcome of the game and that correspond to a predefined set of game outcomes including winning and losing outcomes;

a display for displaying game play including game outcomes to a player;

a set of inputs on each EGM from which a player may interface with the EGM;

an EGM controller for controlling game play on the EGM;

a mode controller for switching exclusively between:

a local access mode in which a player interacts with a selected EGM among the plurality of EGMs using the set of inputs on the selected EGM;

a remote access mode in which a player interacts with the selected EGM using a first mobile device among the at least one mobile device; and an identification code associated with each EGM; and initiating pairing of a selected first subset of EGMs, the first subset including more than one EGM among the plurality of EGMs, with a first mobile device of the at least one mobile device through at least one gateway between each EGM of the first subset and the first mobile device wherein the gateway is configured to propagate communication between each EGM of the first subset and the first mobile device, wherein the player of the first mobile device is able to control in parallel each of the EGMs of the first subset via the first mobile device once the pairing is established; and wherein an output of screens from each EGM of the first subset controlled by the player is alternated on the first mobile device.

11. The method of claim 10 wherein the game play content is provided in a form that comprises one or more among the group comprising: (a) screenshot images; (b) video content; or (c) audio content.

12. The method of claim 10 wherein any of the at least one mobile devices is pairable with any one of the plurality of EGMs in the system.

13. The method of claim 10 wherein the first mobile device displays game states on a screen of the first mobile device and buttons operable by the player corresponding to a particular state of the game.

14. The method of claim 10 wherein a user interface on the at least one mobile device detects screen size of the at least one mobile device and adjusts game functions displayed to the player during remote play on the at least one mobile device.

15. The method of claim 10 further comprising capturing images of game play at an EGM and transmitting captured images to the at least one mobile device for display on a screen of the at least one mobile device.

16. The method of claim 10 wherein the at least one mobile device is from among the group comprising: (a) a smartphone; (b) a tablet computer; (c) a laptop computer; (d) a portable video gaming device; and (e) a dedicated device on which a player may access an EGM in a remote access mode.

17. The method of claim 10 wherein the identification code is of a type from the group comprising: (a) a quick response code ("QR"); (b) a bar code; (c) a RF identification tag; or (d) another code that is detectable by the at least one mobile device.

* * * * *